US006253651B1

(12) United States Patent
Bessemer

(10) Patent No.: US 6,253,651 B1
(45) **Date of Patent: *Jul. 3, 2001**

(54) ROTARY KNIFE CUTTER

(75) Inventor: Robert H. Bessemer, York, PA (US)

(73) Assignee: The Conair Group, Inc., Pittsburgh, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/855,370

(22) Filed: May 13, 1997

Related U.S. Application Data

(63) Continuation of application No. 08/595,819, filed on Feb. 2, 1996, now abandoned.

(51) Int. Cl.[7] ..... B26D 1/26

(52) U.S. Cl. ..... 83/42; 83/54; 83/171; 83/594; 83/675

(58) Field of Search ..... 83/171, 591, 594, 83/595, 355, 675, 444, 54, 932, 329, 331, 324, 42

(56) References Cited

U.S. PATENT DOCUMENTS

| | | | | |
|---|---|---|---|---|
| 1,664,050 | * | 3/1928 | Sheehan . | |
| 2,217,766 | | 10/1940 | Neff | 83/355 |
| 3,104,579 | * | 9/1963 | Blankenship . | |
| 3,374,698 | | 3/1968 | Sleeper | 83/171 |
| 3,476,002 | * | 11/1969 | Bardenhagen . | |
| 3,646,894 | * | 3/1972 | Hasten et al. | 99/86 |
| 3,685,560 | | 8/1972 | Siegmann | 83/444 |
| 3,747,456 | | 7/1973 | Kochinashvili et al. | 83/444 |
| 3,815,460 | * | 6/1974 | Bardenhagen | 83/310 |
| 3,830,126 | * | 8/1974 | Ringe | 83/310 |
| 3,831,482 | | 8/1974 | Eichler et al. | 83/675 |
| 4,095,751 | * | 6/1978 | Artin | 241/37.5 |
| 4,277,995 | | 7/1981 | Sontheimer | 83/355 |
| 4,319,505 | | 3/1982 | Otake et al. | 83/295 |
| 4,398,438 | | 8/1983 | Seragnoli | 83/594 |
| 4,398,439 | * | 8/1983 | Bryan et al. | 83/420 |
| 4,459,887 | * | 7/1984 | Ingham | 83/311 |
| 4,653,362 | | 3/1987 | Gerber | 83/16 |
| 4,848,723 | | 7/1989 | Borzym | 83/54 |
| 5,000,812 | | 3/1991 | Murphy | 83/324 |
| 5,265,506 | | 11/1993 | Aihara et al. | 83/171 |
| 5,327,803 | * | 7/1994 | DeMey | 83/152 |
| 5,588,344 | * | 12/1996 | Chun . | |
| 5,628,237 | * | 5/1997 | Lindee et al. | 83/409 |

FOREIGN PATENT DOCUMENTS

| | | | |
|---|---|---|---|
| 967716 | 8/1964 | (GB) | 83/355 |
| 1480983 | 5/1989 | (SU) | 83/171 |

* cited by examiner

*Primary Examiner*—Kenneth E. Peterson
(74) *Attorney, Agent, or Firm*—Buchanan Ingersoll, P.C.

(57) ABSTRACT

A rotary knife cutter is provided. The rotary knife cutter has a flywheel to which knife blades are attached at the circumference of the flywheel. The flywheel is directly driven by a gear reducer that is directly connected to a servo-motor. The servo-motor may be operated to rotate the flywheel at a constant speed for cutting or the servo-motor may cause the flywheel to stop after each revolution to regulate the cutting desired. One or more blades may be attached to the flywheel depending upon the desired type of cuts to be made. Cutter bushings varying in size and cross-sectional shape may be utilized to guide a particular cross-sectional size and shape of material to the cutter knives.

10 Claims, 4 Drawing Sheets

ROTARY KNIFE CUTTER

This application is a continuation of application Ser. No. 08/595,819 filed Feb . 2, 1996, now abandoned.

BACKGROUND OF THE INVENTION

1. Field of the Invention.

This invention relates to a cutter mechanism which may be used for cutting plastic extrudate such as pipe, molding, or other shapes as well as rubber, ceramics, and food stuffs into discrete lengths as the material is delivered to the cutter mechanism.

2. Description of the Prior Art.

Various types of cutters and saws have been utilized to cut plastic extrudate to a desired length after the extrudate is formed in a continuous manner. Prior cutters have used rotating knives that are controlled by clutches that intermittently transmit power from a motor to the cutter knives so that the cutter knives will operate when required to cut the extrudate. Other cutters have been developed which have an electric servo-motor connected directly to the cutting blades which are relatively light weight and travel at very high speeds. These lightweight blades are not sufficient to cut heavy duty extrudate and do not accurately cut some of the lighter weight extrudate.

The cutters that have a clutch mechanism between the electric motor and the cutter blade are not practical because the clutch mechanisms wear rapidly and require a high degree of maintenance and replacement.

The cutters in which the blades are directly connected to the electrical servo-motor do not provide sufficient momentum of the blade to cut heavy extrudate or other material.

I have found that by connecting a servo-motor to a weighted flywheel that carries the cutter blades, the cutter blades can move more slowly and yet have sufficient momentum to cut heavy extrudate accurately. The present invention is directed to such an arrangement.

SUMMARY OF THE INVENTION

In accordance with the present invention, there is provided a rotary knife cutter. The rotary knife cutter includes a knife blade secured to the outer circumference of a flywheel. The flywheel is fixed to a rotatable horizontal shaft for rotation within a cutter housing. An electrical servo-motor is connected to the shaft to rotate the shaft to drive the flywheel and the knife blade. A cutter bushing mounted in a bushing guide on the cutter housing above the flywheel guides material into a zone where the knife cuts the material upon rotation of the flywheel. The knife blade moves upwardly and across the material as the knife blade cuts the material.

Further in accordance with the present invention, there is provided a rotary knife cutter which includes a cutter housing and a rotatable horizontal shaft positioned for rotation in the cutter housing. A flywheel is fixed to the horizontal shaft for rotation with the horizontal shaft and a knife blade is secured to the circumference of the flywheel. A planetary gear reducer that has an input connection and an output connection is fixed to the cutter housing with the output connection connected to the horizontal shaft to drive the horizontal shaft. An electrical servo-motor is fixed to the cutter housing and has an output drive shaft that is connected to the planetary gear reducer input connection to drive the reducer when the electrical servo-motor output drive shaft rotates. A bushing guide is mounted on the cutter housing above the flywheel and has an opening to receive cutter bushings of varying internal sizes and shapes so that a cutter bushing that conforms to the size and cross-section of the material being cut is positionable within the bushing guide above the flywheel. The cutter bushings include two longitudinally spaced parts so that the knife blade passes between the longitudinally spaced parts as the knife blade cuts the material. The bushing guide is mounted on the cutter housing so that the center of the cutter bushing is vertically above the axis of the rotatable horizontal shaft whereby the knife blade moves upwardly and across the material as the knife blade cuts the material.

Accordingly, an object of the present invention is to provide a rotary knife cutter which efficiently cuts material in a wide variety of shapes and sizes.

Another object of the present invention is to provide a rotary knife cutter that has a heavy flywheel to which the knife blade or blades are attached.

Another object of the present invention is to provide a rotary knife cutter that has an electrical servo-motor driven planetary gear reducer that is directly connected to a flywheel carrying the knife blade to eliminate the use of clutches.

These and other objects of the present invention will become apparent as this invention is described in the following specification, the accompanying drawings and the appended claims.

DESCRIPTION OF THE PREFERRED EMBODIMENT

Figure 1:
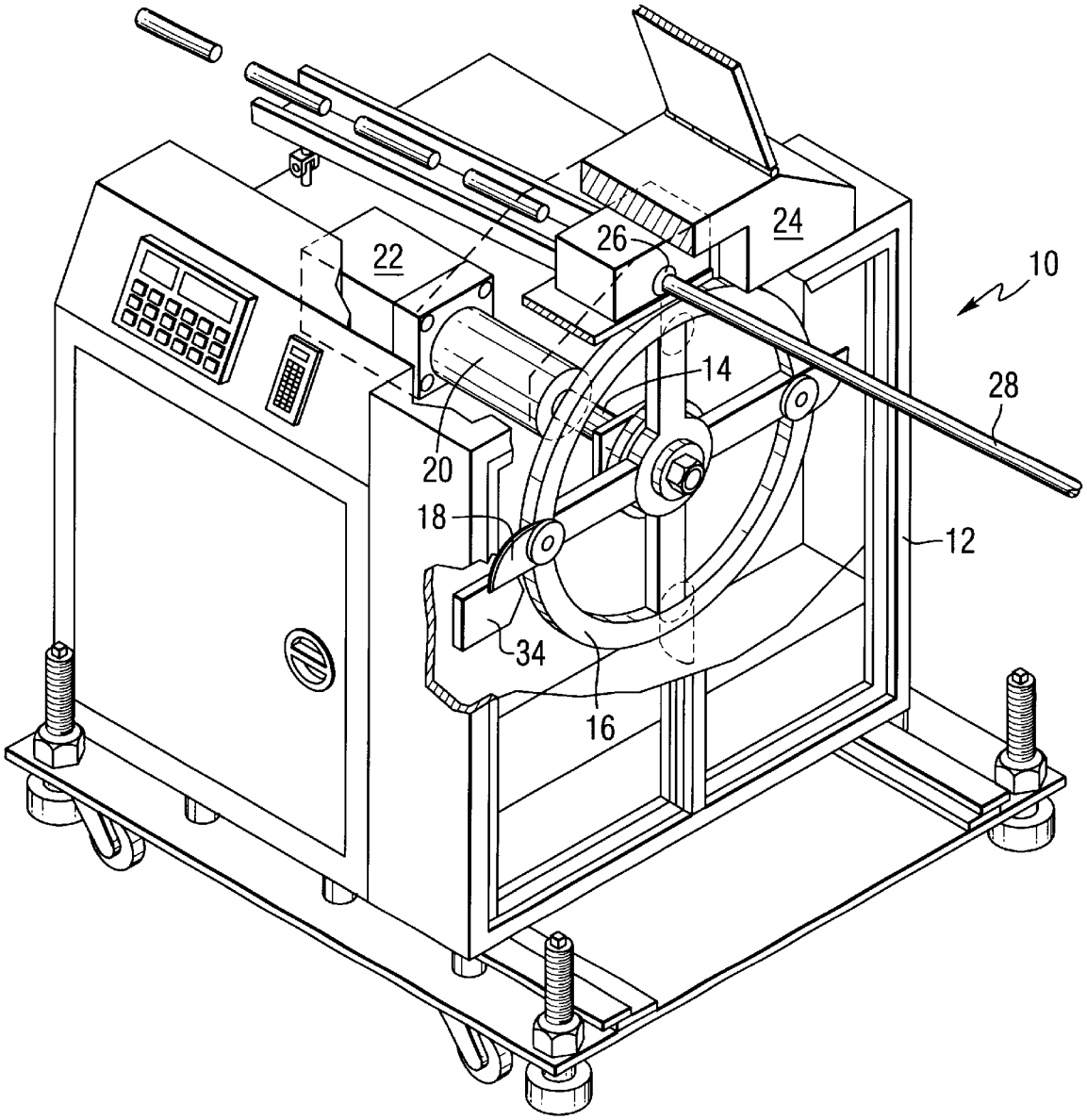
FIG. 1 is a perspective view of the rotary knife cutter of the present invention with certain parts broken away.
Figure 2:
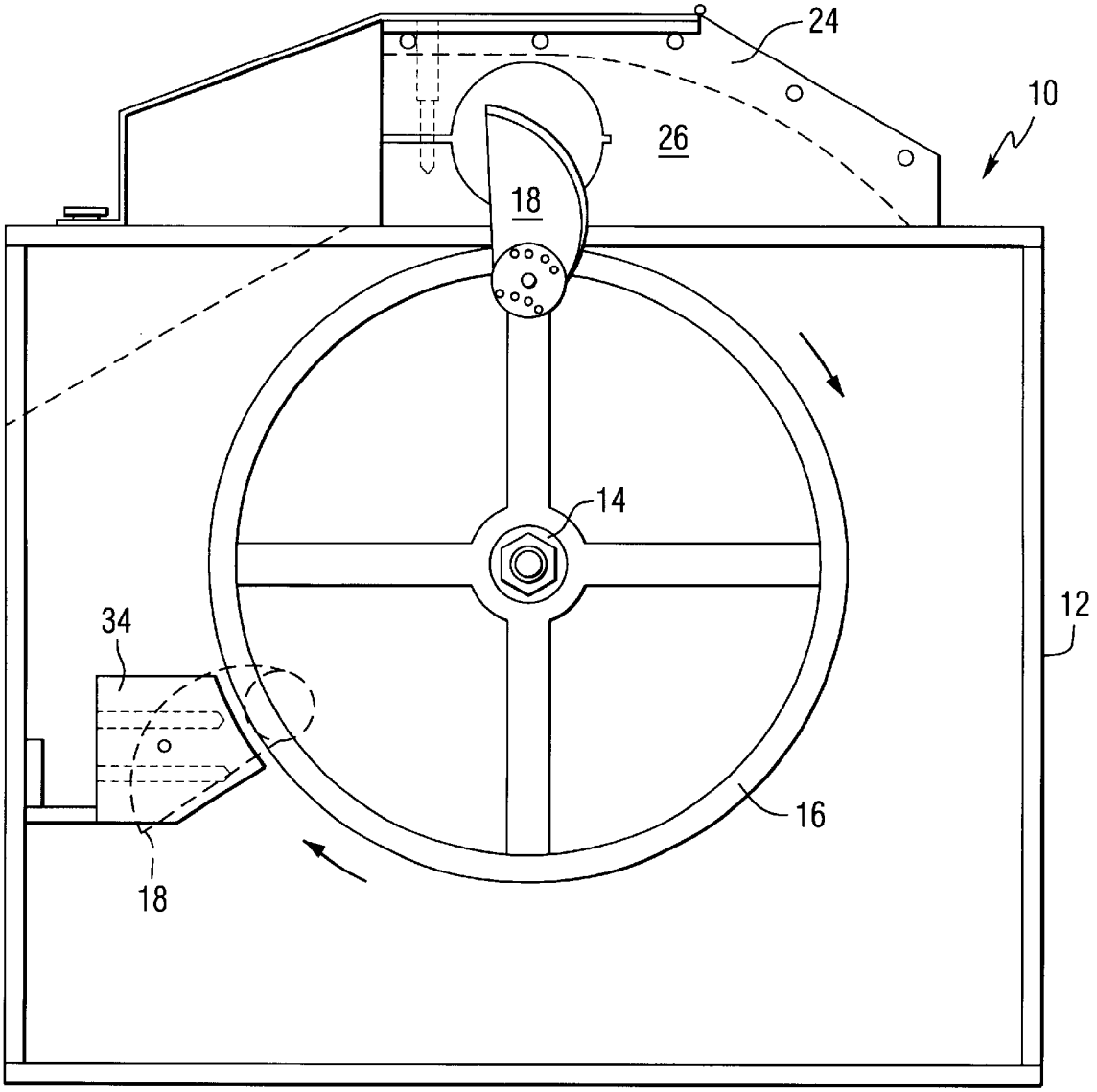
FIG. 2 is an end view of the rotary knife cutter of FIG. 1.
Figure 3:
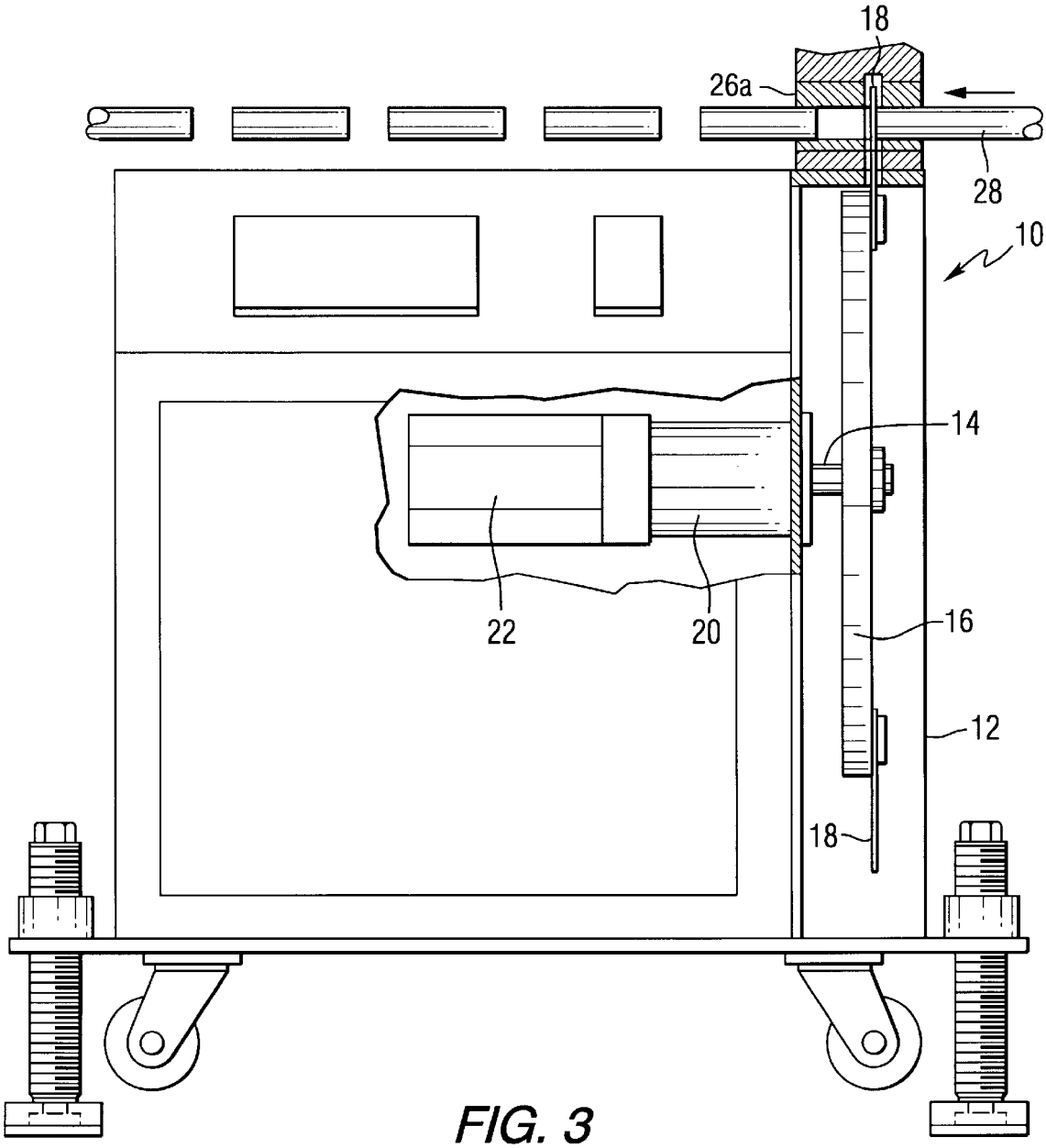
FIG. 3 is a side view with parts broken away of the rotary knife cutter of FIGS. 1 and 2.

Referring to the drawings, and particularly to FIGS. 1, 2 and 3, there is shown a rotary knife cutter 10 having a cutter housing 12 that has a rotatable shaft 14 positioned horizontally within the housing 12. The shaft 14 has a flywheel 16 keyed to the shaft 14 for rotation within the housing 12 with shaft 14.

One or more knife blades 18 are fixed to the flywheel 16 at the circumference of the flywheel as best seen in FIGS. 1 and 2. A planetary gear reducer 20 and an electrical servo-motor 22 are secured to housing 12 to drive the rotatable shaft 14 as will be described.

Figure 4:
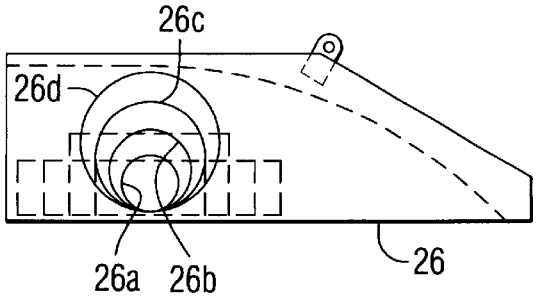
FIG. 4 is a schematic illustration of the cutter bushing of the present invention.

A bushing guide 24 is fixed to housing 12 to receive cutter bushings 26 which are shown schematically in FIG. 4. The bushing guide 24 may receive a plurality of varying cutter bushings that vary both in size and in cross-sectional shape. In FIG. 4, several sizes of circular cutter bushings are shown at 26*a*, 26*b*, 26*c* and 26*d*. Anyone of those cutter bushings can be utilized within the bushing guide 24 so that various sizes of circular pipe can be accurately cut by the rotary knife cutter of the present invention. In similar fashion, cutter bushings of square cross-section, triangular cross-section, or other shaped cross-sections and of varying sizes can be placed within the bushing guide 24 to accurately guide material of a particular size and shape to be cut by the knife or knives 18 of the rotary knife cutter.

As shown in FIGS. 1 and 3, the material 28, which may be plastic extrudate, rubber, ceramic material or food stuffs, enters a cutter bushing 26 and, as the flywheel 16 turns, the knives cut the material 28 into pieces. As best seen in FIG. 3, the cutter bushing 26a is longitudinally separated to straddle the knife 18 so that the knife 18 moves between the longitudinally separated parts of bushing 26*a* and accurately cuts the extrudate 28.

Figure 5:
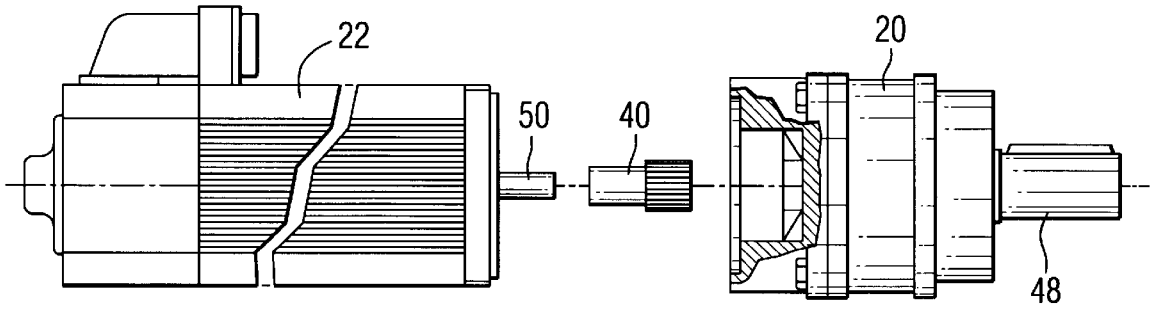
FIG. 5 is an exploded view of the servo-motor and planetary gear reducer of the present invention.
Figure 6:
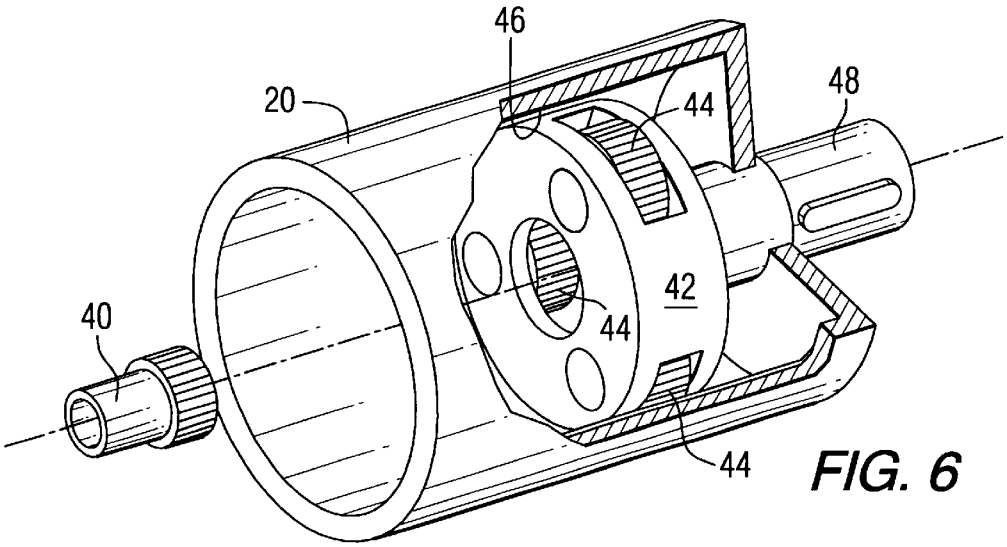
FIG. 6 is an exploded perspective view, partially broken away, of the planetary gear reducer of the present invention.
Figure 7:
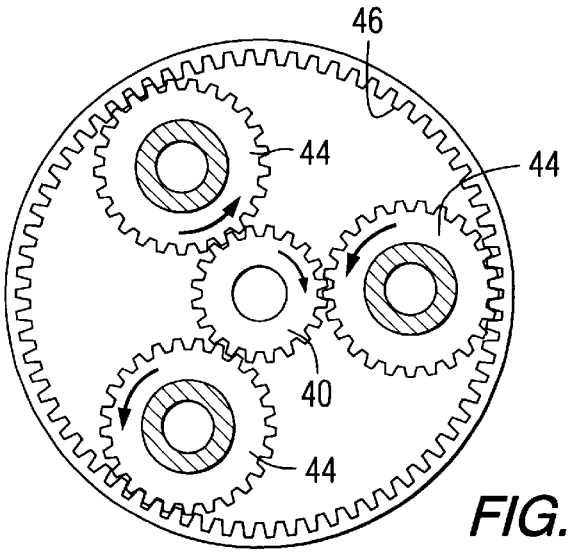
FIG. 7 is a sectional end view of the planetary gear reducer of FIG. 6.

Referring now to FIGS. 5, 6 and 7, additional details of the planetary gear reducer 20 and the electrical servo-motor 22 are shown. The electrical servo-motor 22 is preferably a DXM-6200 Modle electrical servo motor sold by the Emerson Electronic Motion Controls Division of Emerson Electric Company located in Chanhassen, Minnesota. As seen in FIG. 5, the electrical servo-motor 22 has a drive shaft 50.

The planetary gear reducer 20 is preferably an ATO 18-010 TRUE PLANETARY gear head manufactured by Micron Instrument Corporation of Ronkonkona, N.Y. The planetary gear reducer 20 has a reduction ratio of 10 to 1. As seen in FIGS. 6 and 7 , the input 40 to gear reducer 20 is fixed to a sun gear. The sun gear meshes with planetary gears 44 that are retained by a spider 42. The planetary gears 44 mesh with a ring gear 46 that is fixed to the casing of planetary gear reducer 20. An output shaft 48 is fixed to the spider 42. The output shaft 48 of planetary gear reducer 20 is secured to shaft 14 to which the flywheel 16 is keyed for rotation.

The rotary knife cutter of the present invention is very versatile and provides a single cutter for processors who need one cutting system for a variety of applications. The rotary knife cutter 10 of the present invention can go from cutting small parts at high speeds, for potentially thousands of cuts per minute, to cutting extremely large tubes and profiles. This rotary knife cutter cutter 10 can handle parts so large that a saw would have been required previously.

The flywheel 16 is optimally 24 inches in diameter. It is mounted below the cutter bushing 26 and the center of the cutter bushing 26 is directly vertically above the axis of shaft 14 as best seen in FIG. 2. The electrical servo-motor 22 can rotate up to 3,000 r.p.m. With the 10 to 1 reduction of the planetary gear reducer 20, the output shaft 48 of gear reducer 20 can rotate up to 300 r.p.m. If twenty four knives 18 are attached around the circumference of the flywheel 7,200 cuts per minute can be made with this rotary knife cutter. The servo-motor 22 can also be made to operate so that the flywheel 16 stops after every revolution so that a single knife utilized on the flywheel 16 can make only a few cuts per minute when longer pieces of material are desired. Because of the relatively large diameter weighted flywheel, the knife blades 18 move at a high linear speed with high momentum.

It will be noted that the servo-motor 22 directly drives the planetary gear reducer 20 which, in turn, directly drives the shaft 14 that turns flywheel 16. There are no clutches to wear and maintain. The heavy flywheel 16 produces momentum to carry the knives 18 through the extrudate.

As shown on FIGS. 1 and 2, a knife blade heater 34 may be positioned to heat the knife blade or blades 18 as they rotate. The knife blade heater is particularly effective on slower rotational speeds of the flywheel 16. The knife blade heater 34 is preferably an electrically heated element which heats the knife blade 18 as it passes.

According to the provisions of the patent statutes, I have explained the principle, preferred construction and mode of operation of our invention and have illustrated and described what I now consider to represent its best embodiment. However, it should be understood that, within the scope of the appended claims, the invention may be practiced otherwise than as specifically illustrated and described.

I claim:

1. A rotary knife cutter comprising:

a. a flywheel connected to a horizontal shaft positioned for rotation in a cutter housing;

b. at least one knife blade non-retractably secured to the circumference of said flywheel, said at least one knife blade projecting radially outward from said flywheel to cut material;

c. a planetary gear arrangement having an output connected to said horizontal shaft;

d. a servo-motor having an output connected to an input of said planetary gear arrangement for rotation of said horizontal shaft to drive said flywheel and said at least one knife blade;

e. a cutter bushing mounted in a bushing guide on said cutter housing, said cutter bushing guiding material into a cutting zone above said flywheel where said knife cuts said material upon rotation of said flywheel; and f. a controller associated with said servo-motor, said controller causing said servo-motor to stop rotation of said flywheel each revolution to cut a single section of material each revolution.

2. The rotary knife cutter of claim 1 further comprising:

a. said bushing guide mounted on said cutter housing with the center of said cutter bushing vertically above a longitudinal axis of said horizontal shaft;

b. said bushing guide having an opening configured to orient said material with a widest dimension lying vertically above the flywheel; and c. as said flywheel rotates said at least one knife blade is swept along an arc having a center aligned with a centerline of said material whereby a maximum width of said material is cut by a knife blade of minimum thickness for a given diameter flywheel.

3. The rotary knife cutter of claim 1 wherein said bushing guide and said cutter bushing each comprises a pair of spaced apart portions and said knife blade passes between said pair of spaced apart portions as said at least one knife blade cuts said material.

4. The rotary knife cutter of claim 1 further comprising a knife blade heater attached to said cutter housing and adjacent the path traveled by said knife blade as said flywheel rotates such that said knife blade is heated by said knife blade heater.

5. The rotary knife cutter of claim 1 further comprising a cutter bushing interchangeably received in said bushing guide.

6. The rotary knife cutter of claim 1 wherein said at least on knife blade further comprises a plurality of knife blades non-retractably secured at spaced apart positions on the circumference of said flywheel.

7. A method of cutting using a rotary cutter, said method comprising:

a. connecting an output of a planetary gear arrangement to a flywheel;

b. connecting an output of a servo motor to an input of said planetary gear arrangement;

c. providing at least one non-retractable knife blade fixed to the circumference of said flywheel;

d. controlling said servo-motor with a controller to stop rotation of said flywheel after each revolution via said planetary gear arrangement; and e. feeding said material into a cutting zone above said flywheel such that said at least one knife blade cuts a single section of material each revolution of said flywheel.

8. The method of claim 7 further comprising feeding said material into said cutting zone at an orientation where said at least one knife blade cuts across a widest dimension of said material as said flywheel rotates such that a maximum width of said material is cut by a knife blade of minimum thickness for a flywheel having a given diameter.

9. The method of claim 7 further comprising heating said at least one knife blade as said flywheel rotates.

10. The method of claim 7 further comprising providing a plurality of noni-retractablc knife blades fixed at spaced apart positions on the circumference of said flywheel.

* * * * *